US005342270A

United States Patent [19]

Jones

[11] Patent Number: 5,342,270

[45] Date of Patent: Aug. 30, 1994

[54] EXERCISE MACHINE FOR UPPER TORSO

[76] Inventor: Arthur A. Jones, 1155 NE. 77th St., Ocala, Fla. 32670

[21] Appl. No.: 20,807

[22] Filed: Feb. 22, 1993

Related U.S. Application Data

[63] Continuation-in-part of Ser. No. 947,284, Sep. 15, 1992, and a continuation-in-part of Ser. No. 145, Jan. 4, 1993, Pat. No. 5,304,107.

[51] Int. Cl.[5] ..... A63B 21/062

[52] U.S. Cl. ..... 482/98; 482/97; 482/137; 482/142

[58] Field of Search ..... 482/97-103, 482/133, 138, 142, 908

[56] References Cited

U.S. PATENT DOCUMENTS

| | | | |
|---|---|---|---|
| 3,588,101 | 6/1971 | Jungreis | 482/97 |
| 3,708,166 | 1/1973 | Annas . | |
| 3,917,262 | 11/1975 | Salkeld . | |
| 4,730,829 | 3/1988 | Carlson | 482/137 X |
| 4,964,632 | 10/1990 | Rockwell | 482/137 X |
| 4,982,955 | 1/1991 | Heasley | 482/100 |
| 5,002,269 | 3/1991 | Jones | 482/100 X |
| 5,044,631 | 9/1991 | Jones . | |
| 5,044,632 | 9/1991 | Jones . | |
| 5,050,873 | 9/1991 | Jones | 482/97 |
| 5,141,480 | 8/1992 | Lennox et al. | 482/908 X |

*Primary Examiner*—Robert Bahr
*Attorney, Agent, or Firm*—William E. Mouzavires

[57] ABSTRACT

A machine for exercising the pectoral muscles having a pair of synchronous movement arms pivotable about oblique axes by the user moving the arms from the user's sides to outstretched convergent positions. A constrained linkage connects the movement arms to a vertical drive rod which drives a lever at the base of the machine. The lever drives a weight stack pin upwardly to lift one or more resistance weights keyed to the pin. The user is supported by a seat and backrest and linkages are provided to adjust the seat vertically and the backrest horizontally relative to the movement arms.

21 Claims, 5 Drawing Sheets

EXERCISE MACHINE FOR UPPER TORSO

RELATED APPLICATIONS

This application is a continuation in part of my prior co-pending applications, Ser. No. 07/947,284, filed Sep. 15, 1992 entitled EXERCISE MACHINES AND METHODS, pending; and Ser. No. 08/000,145 filed Jan. 4, 1993 and entitled EXERCISE MACHINE, now U.S. Pat. No. 5,304,107. The disclosure of my aforementioned applications are hereby incorporated by reference into the subject application as part hereof.

BACKGROUND AND OBJECTS OF THE INVENTION

The present invention generally relates to machines for exercising the muscles of the upper torso of the human body, especially the pectoral muscles. Numerous machines exist and have been known in the prior art for exercising the aforementioned parts of the human body. Such machines commonly utilize some sort of a movement arm which is moved by the body upon exertion of the muscles to be exercised and against a resistance typically a weight stack. Commonly, the movement arm is connected to the weight stack by an overhead cable and pulley system which increases the height of the machine and also introduces a certain amount of friction in the transmission of the drive thereby reducing efficiency.

An object of the present invention is to provide a novel and improved exercise machine which utilizes a weight stack for resistance to the movement arm but which eliminates the need of an overhead cable and pulley system for transmitting the drive from the movement arm to the weight stack.

A further object of the present invention is to provide novel and improved machines and methods for exercising one or more upper parts of the human body, including, for example, the upper torso including the pectoral muscles, and which are safe and effective. Included herein is the provision of such a machine and a method which incorporates an improved drive system for transmitting movement from a movement arm to a weight stack.

A further object of the present invention is to provide a novel and improved machine and method for exercising the muscles of the upper torso through the movement of a movement arm about an axis that extends at an angle to the vertical and horizontal planes.

SUMMARY OF PREFERRED EMBODIMENT

In summary, the preferred embodiment of the present invention includes a movement arm pivotable by the user exerting the muscles of the parts of the body to be exercised. The movement arm is connected to a resistance weight stack by a drive rod pivotally connected at its upper end to the movement arm and its lower end to a weight stack shaft also termed in the art a "pin" which extends vertically through the weight stack and is selectively connectable to one or more weights of the weight stack. The connection between the drive rod and the weight stack shaft however is effected through a linkage including a main lever having an intermediate portion pivotally connected to the lower end portion of the drive rod. One end of the lever is pivotally mounted to a stationary support by a link while the opposite end is pivotally connected to the weight stack shaft. Pivoting of the movement arm in one direction by the user will, through the lever, raise the weight stack shaft and the weight(s) connected to the latter. When the exerciser relieves force on the movement arm, the movement arm will pivot in the opposite direction while the resistance weights descend to the starting position by gravity. In the preferred embodiment, the movement arm pivots about an axis which extends at an angle, preferably forty-five degrees (45°) to the vertical and/or horizontal planes. Additionally the movement arm includes two vertical extensions independently mounted on oblique axes but synchronized through a common connection to the drive rod.

DRAWINGS

Other objects and advantages of the present invention will become apparent from the following detailed description taken in conjunction with the drawings in which.

DETAILED DESCRIPTION

Figure 1:
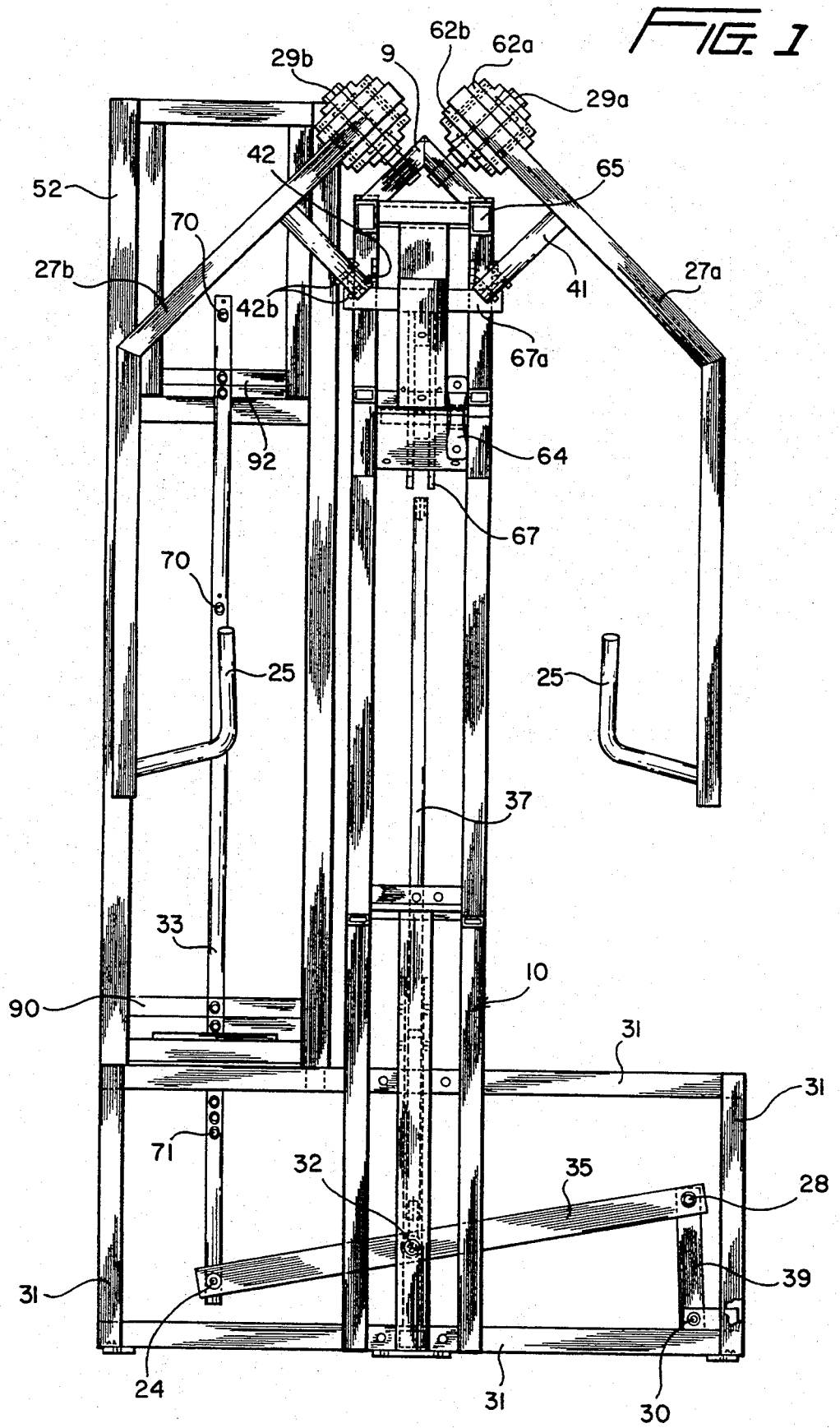
FIG. 1 is a front elevational view of a machine constituting one preferred embodiment of the present invention but with portions removed.
Figure 5:
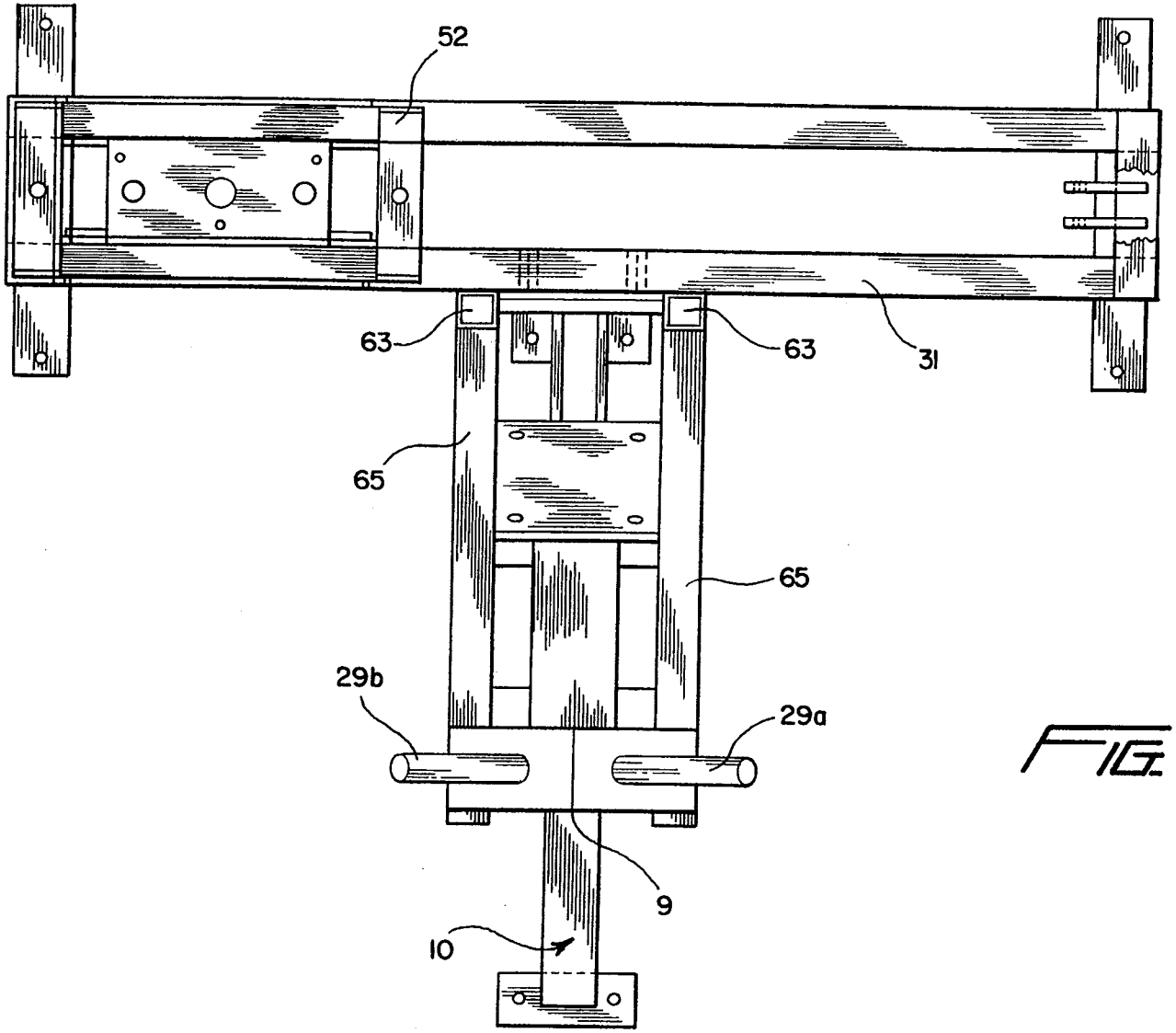
FIG. 5 is a plan view of the machine with parts removed.

Referring now to the drawings in detail, there is shown for illustrative purposes only, a machine embodying the present invention particularly suited for exercising muscles of the upper body especially the pectoral muscles. In the preferred embodiment shown, the machine includes a front frame generally designated 10 and a rear frame generally designated 31 extending at right angles to front frame 10 and including at one end an upstanding vertical weight stack frame 52 as shown in FIGS. 1 and 5. Front frame 10 includes a vertical upstanding frame 63 and 65 for mounting a movement arm 27 as will be described below. The frames are made from elongated rails or tubular stock of high strength metallic material, however any other suitable material may be utilized as long as it provides the necessary strength and weight. Front frame 10 includes a seat generally designated 43 mounted to the frame by means of a parallelogram linkage generally designated 55. Linkage 55 is adjustable vertically to change the elevation of the seat 43 to suit the user and once adjusted it is held in place by a latch plate **4*a* which receives a latch pin 2 on a latch arm 3 which is actuated by means of a handle 54 shown in FIG. 2. Seat 43 is connected to the linkage by link 55*a* and a link 57. Link 55*a* as well as opposite parallel links 55*b* are moveable relative to a stationary link formed by a stationary frame element 73 fixed to the front frame 10**.

Figure 2:
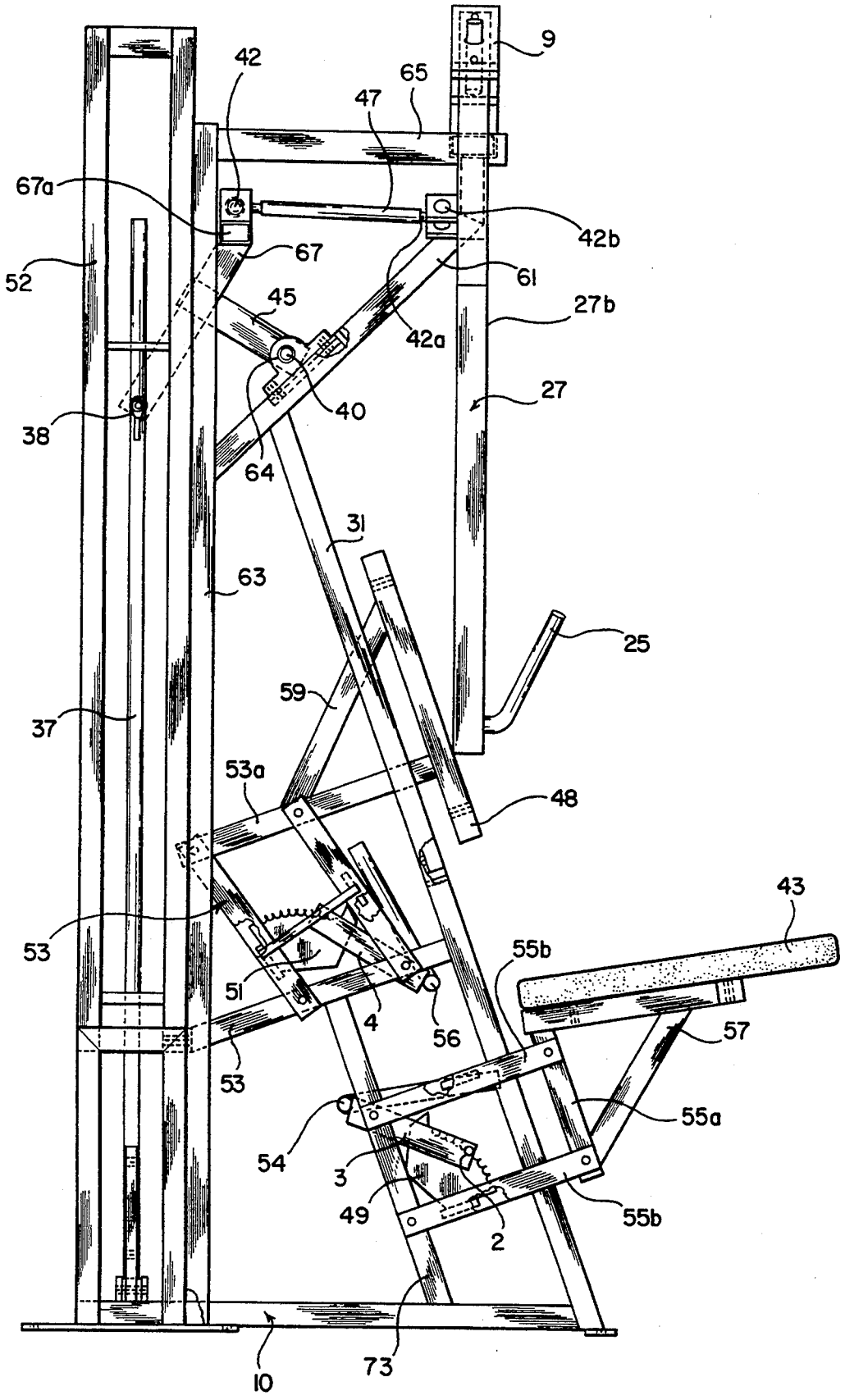
FIG. 2 is a side elevational view of the right side of the machine.

Front frame 31 further includes a backrest 48 which is mounted to front frame 10 via a parallelogram linkage 53. Linkage 53 is similar to seat linkage 55 except that the backrest 48 is connected by link 59 to the upper link **53*a* of the linkage 53 so that the backrest 48 will move in the forward-rearward direction. Linkage 53 is adjustable in the forward-rearward direction to change the position of the backrest 48 relative to the movement arm 27 to suit the user and once adjusted it is held in place by a latch plate 51 receiving a latch pin on arm 4 which is actuated by means of a handle 56 as shown in FIG. 2**. Such adjustment enables the user to maximize convergence of the arms during an exercise to increase efficiency and exercise of the muscles.

Figure 3:
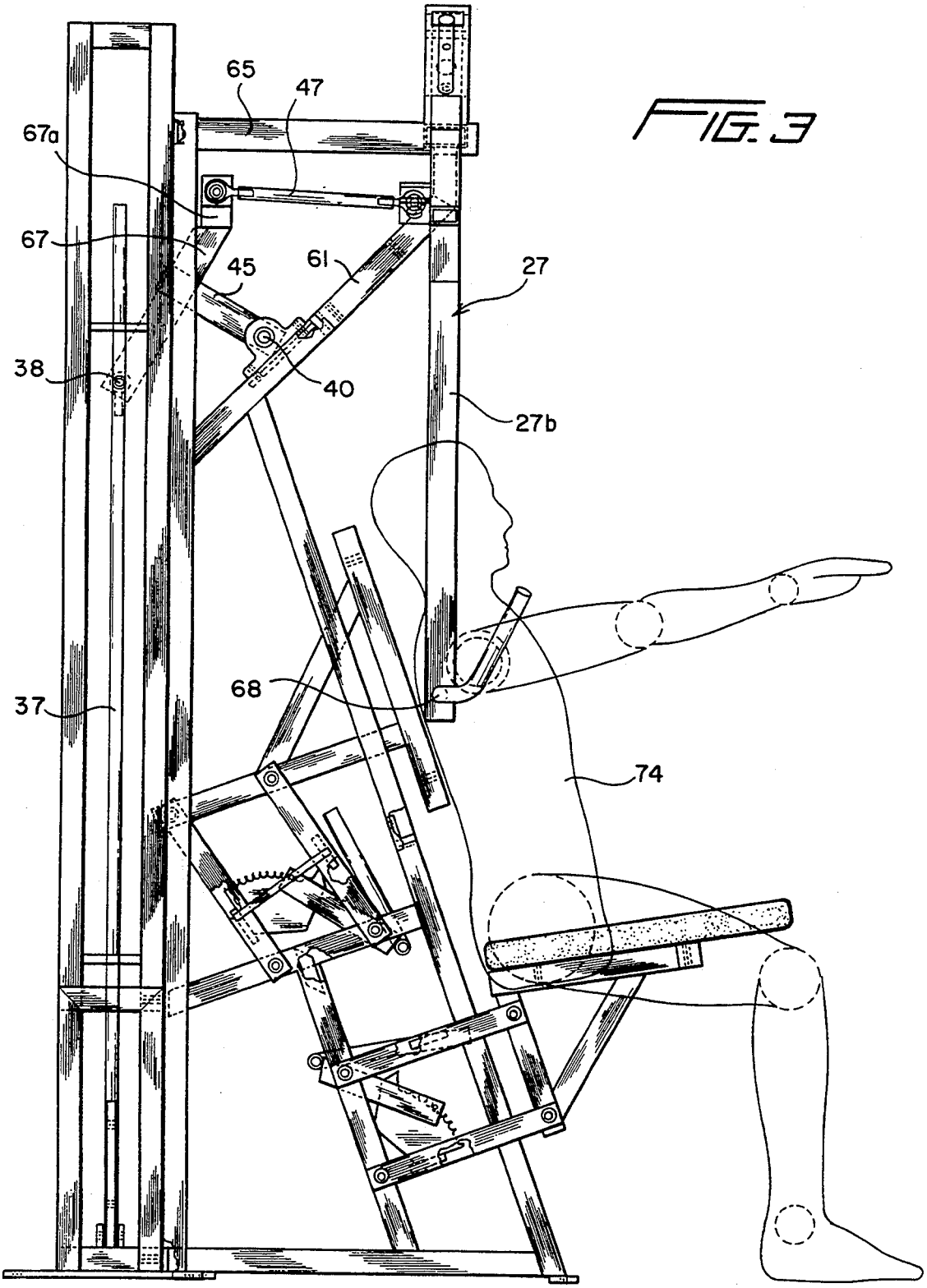
FIG. 3 is a view similar to FIG. 2 but also showing a user seated on the machine in the start position of an exercise.

To exercise the muscles, the user 74 sits on seat 43 as shown in FIG. 3 and with both arms grasps the movement arm generally designated 27 and pushes the movement arm outward away from his body (see FIG. 4) in a plane which extends at an angle preferably forty-five degrees (45°) to the vertical and/or horizontal. Such movement is yieldingly resisted by one or more weights in a weight stack housed in frame 52 situated to the rear and side of the user. Pressure against the movement arm 27 is then released by the user causing the resistance weight(s) to descend to the starting position. The user then repeats the exercise as may be necessary or desirable. Because the extensions *27a, 27b* of the movement arm move along intersecting arcs, the hands of the user will converge as the movement arm is pushed forward by the user. In the start position shown in FIG. 3 the arms are bent and located laterally of the body as shown. In the finish position shown in FIG. 4 the arms are outstretched and convergent with the hands located adjacent each other. In the preferred method the exercise is effected with a resistance weight less than the maximum static strength of the muscles to be exercised and the exercise is repeated until the muscles are fatigued. In addition, the stroke of the resistance weight is limited to on the order of twelve inches (12") to substantially reduce kinetic energy of the resistance weight.

In the preferred embodiment shown, the movement arm 27 has two extensions *27a* and *27b* as shown in FIG. 1, each of which pivots about an axis that extends forty-five degrees (45°) to a vertical plane as best shown in FIG. 1. These axes are provided by pins *29a* and *29b* which receive bearing assemblies *62a* and *62b* having inner and outer races secured with respect to the pins *29a, 29b,* and extensions *27a, 27b* respectively as shown in FIG. 1. Referring to FIGS. 1 and 2, pivot pins *29a, 29b* are mounted in an inverted V-shaped frame portion 9 fixed to horizontal frame portions 65 which in turn extend forwardly from upstanding frame 63 which is of course stationary. Upper horizontal frame portion 65 is further secured to vertical frame 63 by diagonal strut 61, see FIG. 4. The movement arm extensions *27a* and *27b* are rotated about pivot pins *29a, 29b* by means of handlebars 25 extending inwardly from the lower extremities of the extensions *27a, 27b* as shown in FIG. 1.

In accordance with another aspect of the present invention, a novel drive system is provided to transmit movements of the movement arm 27 to the weight stack. In the preferred embodiment it includes a vertical drive shaft or rod generally designated 37 which is pivotally connected at its upper end 38 to the rear end of a link 67. The latter in turn is pivotally connected at its upper end 42, to a pair of laterally spaced links 47, which in turn are pivotally connected at their forward ends *42a* to the movement arm extensions *27a, 27b* respectively. Links 47 have eyes on their rear ends receiving pins in clevis plates 42 fixed to a bar *67a* fixed across the top of link 67. Clevis plates *42b* are also provided on the movement arm extensions to receive the forward ends *42a* of the links 47. The ends *42a* have eyes which receive pins received in clevis plates *42b*. It will thus be seen that links 47 unite the movement arm extensions *27a, 27b* so that they will move together with the link 67 as will be described further below. Linkage 67 and 47 is constrained by a link 45 fixed at its upper end to an intermediate portion of link 67 while being pivotally mounted at its lower end on a pin 40 which is mounted in bearing blocks 64 (only one shown in FIG. 1) fixed to the diagonal frame 61 as shown in FIGS. 2 and 4.

The drive transmission of the present invention, further includes in the preferred embodiment, a vertical drive shaft or rod generally designated 37 which is connected at its top at 38 to the movement arm 27 via links 67 and 47 as described above. Drive rod 37 is elongated and extends to the bottom area of the machine in the rear frame 31 as best shown in FIG. 1 where it is connected to the resistance weight stack by means of a linkage. As best shown in FIG. 1, the latter includes a main link or lever 35 having an intermediate portion pivotally connected by pivot pin 32 to the lower end of drive shaft 37. One end of lever 35 is pivotally connected at pivot pin 24 to the lower end of the stack pin or shaft 33 which holds the resistance weight plates 90 and 92. The opposite end of lever 35 is pivotally connected to the stationary frame 31 by means, in the preferred embodiment, of a link 39 having one end pivotally connected by pin 28 to the lever 35 and having an opposite end pivotally connected by pin 30 to the frame 31.

Figure 4:
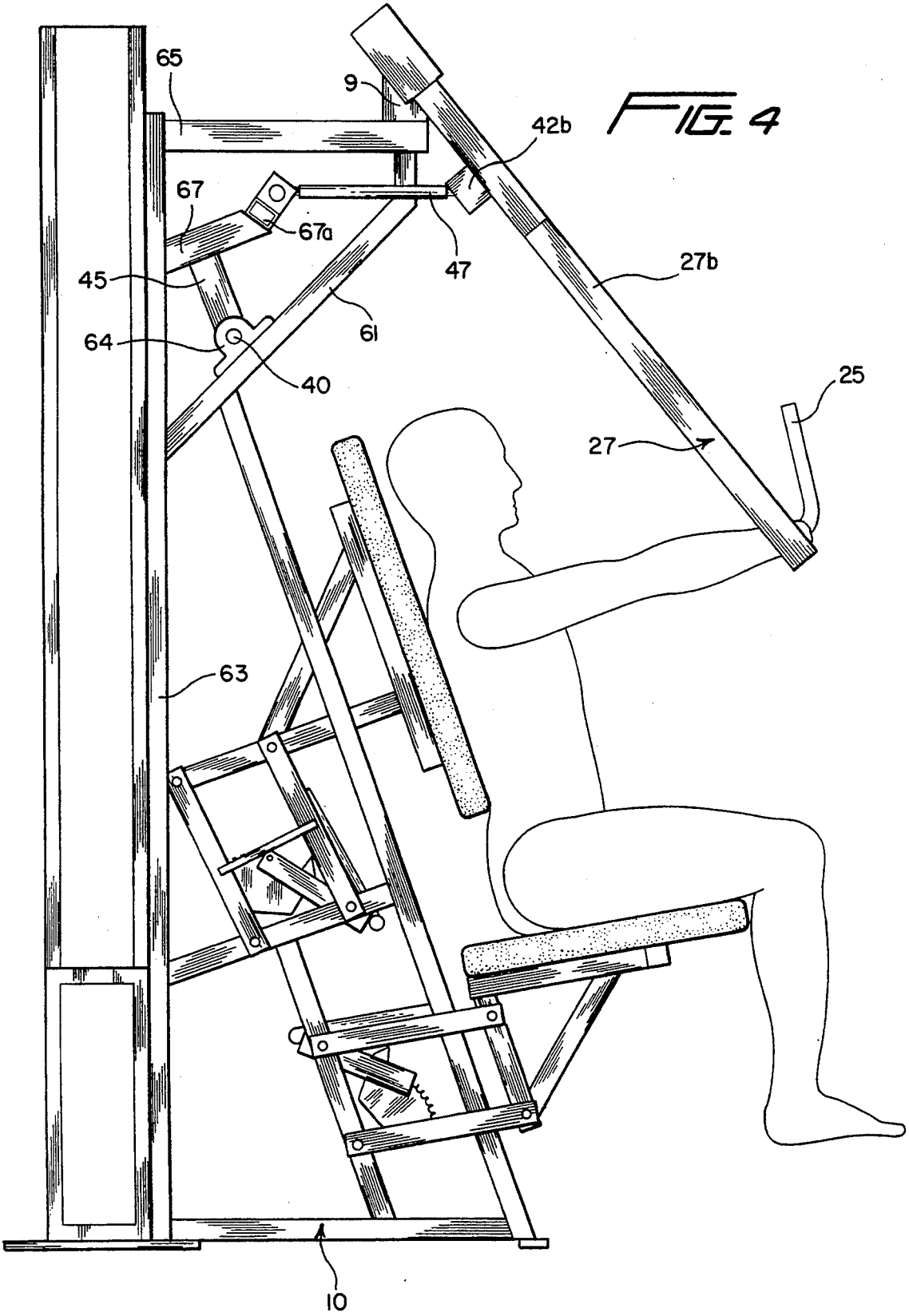
FIG. 4 is a view generally to FIG. 3 but showing the machine moved to another position by the user during an exercise.

It can be seen from FIGS. 3 and 4 that upon forward movement of the movement arm 27, link 47 is pulled forward causing link 67 to also move forwardly while pivoting (clockwise in FIGS. 3 and 4) about pivot axis 40, since link 45 is fixed to link 67. As link 67 pivots forwardly it raises drive shaft 37 by virtue of the pivot connection at 38. This causes link 35 to pivot clockwise as viewed in FIG. 1, in turn causing the weight stack rod 33 to move upward pivoting about axis 24. Link 39, of course, also pivots (about axis 30) to accommodate the pivoting movement of lever 35. The resistance weight plates 90, 92 being connected to rod 33 will of course provide the desired resistance needed by the user for the exercise of the pectoral muscles. Because of the arrangement of the movement arm extensions *27a, 27b,* the arms of the user will converge to maximize the muscles that are exercised as the movement arm extensions are rotated forwardly. Upon release of pressure on the movement arm 27 after its forward movement just described, the aforementioned movement of the parts will be be reversed as the resistance weights descend by gravity to the starting position.

Any suitable resistance weight stack may be employed, however in the preferred embodiment a compond weight stack is utilized such as disclosed in my U.S. Pat. No. 4,834,365 entitled COMPOUND WEIGHT SYSTEM. The disclosure of my aforementioned U.S. Pat. No. 4,834,365 is hereby incorporated by reference into the instant application as part thereof. In the instant embodiment, the compound weight stack includes a frame 52 including first and second independent groups 90 and 92 of weights as shown in FIG. 1. The upper group 92 of weights is connectable to the stack 33 through means of apertures 70 which receive pins which extend through the weights in well-known manner. The lower group 90 of weights is connectable in similar manner to the stack pin 33 through means of the apertures 71 shown in FIG. 1.

It will be seen that the present invention provides an exercise machine with extremely low friction in the transmission between the movement arm and the weight stack thus increasing the efficiency of the machine. In addition, the height of the machine of the present invention may be reduced when compared to prior art machines. Furthermore, the machine of the present invention also allows easy use of the machine by affording direct access to the seat and the resistance weight stack while also allowing the seat and backrest to be easily adjusted while the user is in position in the machine. The adjustment of the backrest enables different subjects with varying body thicknesses and arm lengths to achieve maximum convergence of the arms as the movement arm is pivoted forwardly during an exercise. Adjustment of the seat height enables emphasis upon different muscles, for example the upper, middle or lower pectoral major muscles.

The present invention also enables synchronous movement of both arms eliminating the adverse effects of unbalanced recruitment of the muscles and forces, as well as unbalanced motor control and strength.

Although a preferred embodiment of the invention has been shown and described, the scope of the invention is not limited to that embodiment but rather is indicated in the appended claims.

What is claimed is:

1. A machine for exercising the human body comprising in combination, a movement arm to be moved in generally forward and rearward directions about an axis upon exercising muscles of the body, said axis extending at an acute angle to both a horizontal and vertical plane, said vertical plane extending in said forward and rearward directions, a weight connectable to the movement arm to oppose movement of the movement arm about said axis in one direction, and drive transmission means between said weight and said movement arm including a lever located below and pivotally connected to the weight to lift the weight when the movement arm moves in said one direction, and a link pivotally connected to said lever and pivotally mounted to a fixed support to rotate relative to the fixed support to allow the lever to undergo translatory movement relative to the fixed support and a drive member connected to the movement arm and to the lever at a location between the weight and the link.

2. The machine defined in claim 1 wherein said lever is located below the movement arm.

3. The machine defined in claim 2, including a drive member extending generally vertically and interconnecting the movement arm and said lever, said drive member being pivotally connected to said lever intermediate the ends of the lever, and said weight and link are located on opposite sides of the drive member.

4. The machine defined in claim 1 wherein said movement arm includes two laterally spaced extensions engageable by a user's hands for moving the movement arm upon extension of the user's arms.

5. The machine defined in claim 4 wherein said extensions of said movement arm move along intersecting paths such that the arms converge when moving the movement arms in said one direction.

6. The machine defined in claim 1 further including a seat for receiving a user and a backrest located above said lever for supporting the back of a user, and means for adjusting the backrest in a generally horizontal plane.

7. The machine defined in claim 1 including a weight pin holding the weight, and wherein said lever is pivoted to the pin.

8. The machine defined in claim 7 wherein said pin extends generally vertically and the lever is pivoted to the pin at a location below the weight, and wherein there is further included a vertical weight stack including said weight and being spaced from said movement arm.

9. The machine defined in claim 1 further including a pair of links pivotally connected to each other and pivotally connected to the movement arm and the lever and wherein said linkage further includes a third link pivotally connected to one of said pairs of links while being mounted for pivotal movement about a fixed axis to constrain said pair of links.

10. An exercise machine comprising in combination, a seat for receiving an exerciser, a pair of rotatable movement arms including a pair of laterally spaced portions for receiving the hands of the exerciser for rotating the movement arms, means mounting the movement arms for rotation about axes spaced from each other, resistance means including at least one weight for opposing rotation of the movement arms in one direction, transmission means connecting the weight and movement arms such that when the movement arms are rotated in said one direction by the exerciser the weight will be lifted and when the movement arms rotate in an opposite direction the weight will be lowered, said transmission means including a generally vertically extending drive member, a first linkage interconnecting the movement arms and the drive member and including a pair of links laterally spaced from each other and respectively connected to the movement arms, and a linkage interconnecting said pair of links while being connected to the drive member such that the movement arms will move together in synchronism.

11. The machine defined in claim 10 wherein said movement arms have a first position wherein the user holds the movement arms with the user's arms positioned laterally of the user's body and a second position rotated from the first wherein the user's arms are outstretched while holding the movement arms.

12. The machine defined in claim 11 further including a seat for receiving the user, a backrest for supporting the back of the user, a linkage means for adjusting the seat up and down relative to the movement arms, and a linkage means for adjusting the backrest forwardly or rearwardly relative to the movement arms.

13. The machine defined in claim 12 wherein said movement arms are rotatable about axes which extend at an acute angle between horizontal and vertical planes and converge while moving towards said second position.

14. The machine defined in claim 10 wherein said linkage includes a link mounted for rotation about a stationary axis.

15. The machine defined in claim 14 wherein said transmission means includes a lever connected to a lower end portion of the drive member, said lever being connected to the weight.

16. The machine defined in claim 15 further including a seat for receiving the user, a backrest for supporting the back of the user, a linkage means for adjusting the seat up and down relative to the movement arms, and a linkage means for adjusting the backrest forwardly or rearwardly relative to the movement arms.

17. The machine defined in claims 10 or 16 wherein said movement arms are rotatable as a unit about axes which extend at an acute angle between horizontal and vertical planes.

18. A machine for exercising the human body comprising in combination, a movement arm to be moved about an axis extending at an acute angle to both horizontal and vertical planes upon exercising muscles of the body, a resistance connectable to the movement arm to oppose movement of the movement arm about said axis in one direction, and drive transmission means between said resistance and said movement arm for moving the resistance in response to movement of the movement arm, and wherein said movement arm includes two laterally spaced portions respectively movable by the arms of a user about spaced axes extending at an acute angle to said horizontal and vertical planes, and means interconnecting said movement arm portions such that said portions will move about said axes as a unit.

19. The machine defined in claim 18 wherein said axes are positioned such that the movement arm portions will converge as they move forwardly about said axes.

20. The machine defined in claim 18 wherein said means interconnecting said portions of said movement arm include a pair of links respectively connected to said portions, and a link interconnecting said pair of links.

21. A machine for exercising the human body comprising in combination, a movement arm to be moved about an axis upon exercising muscles of the body, a weight connectable to the movement arm to oppose movement of the movement arm abut said axis in one direction, and drive transmission means between said weight and said movement arm including a lever located below and pivotally connected to the weight to lift the weight when the movement arm moves in said one direction, and a link pivotally connected to said lever and pivotally mounted to a fixed support to allow the lever to undergo translatory movement relative to the fixed support, and wherein said movement arm includes two laterally spaced extensions engageable by a user's hands for moving the movement arm upon extension of the user's arms, wherein said extensions of said movement arm move along intersecting paths such that the arms converge when moving the movement arms in said one direction, and wherein said axis extends at an acute angle to horizontal and vertical planes and wherein there is further included means interconnecting said extensions such that they move as a unit.

* * * * *